US005905043A

United States Patent [19]

Heffron

[11] Patent Number: 5,905,043

[45] Date of Patent: May 18, 1999

[54] TAGGING AND IDENTIFYING ORGANIC LIQUIDS INCLUDING FUELS

[75] Inventor: Peter J. Heffron, Flemington, N.J.

[73] Assignee: Morton International, Inc., Chicago, Ill.

[21] Appl. No.: 09/082,242

[22] Filed: May 20, 1998

[51] Int. Cl.[6] ..... C09B 35/023; C10L 1/22; C10L 1/10

[52] U.S. Cl. ..... 436/56; 436/25; 436/27; 436/28; 436/29

[58] Field of Search ..... 436/56, 25, 27, 436/28, 29

[56] References Cited

U.S. PATENT DOCUMENTS

| | | | |
|---|---|---|---|
| 5,142,030 | 8/1992 | Zimin et al. | 534/649 |
| 5,156,653 | 10/1992 | Friswell et al. | 44/328 |
| 5,252,106 | 10/1993 | Hallisy | 44/328 |
| 5,560,855 | 10/1996 | Hinton et al. | 252/68 |
| 5,737,871 | 4/1998 | Friswell | 44/328 |

*Primary Examiner*—Jill Warden
*Assistant Examiner*—Yolanda E. Wilkins
*Attorney, Agent, or Firm*—Wayne E. Nacker; Gerald K. White

[57] ABSTRACT

A water-immiscible organic fluid is tagged and identified by tagging the organic fluid with between about 0.25 and about 100 ppm of a marker compound having the formula:

(I)

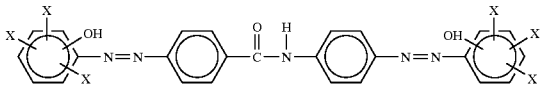

where the OH groups are either ortho or para to the diazo moieties, and the Xs are the same or different and are selected from $C_1$–$C_{12}$-alkyl, Cl, Br, F, $NH_2$, CN, $NO_2$, $NH(C_{1-3}\text{-alkyl})$ and $N(C_{1-3}\text{-alkyl})_2$, and the fluid is identified by extracting the tagged fluid with an alkaline aqueous extractant having a pH above about 12 and containing, based on 100 parts by weight of said extractant, between about 10 and about 60 parts by weight of an organic cosolvent having the formula:

$$R^1—O—R^2—NH_2 \quad \text{(II)}$$

where $R^1$ is $C_1$–$C_3$-alkyl, and $R^2$ is $C_2$–$C_6$-alkylene.

4 Claims, No Drawings

TAGGING AND IDENTIFYING ORGANIC LIQUIDS INCLUDING FUELS

The present invention is directed to tagging organic liquids, particularly petroleum fuels, with markers and identifying the tagged petroleum fuels by extraction of the markers.

BACKGROUND OF THE INVENTION

As described in a variety of patents, including U.S. Pat. Nos. 5,560,855, 5,156,653, 5,737,871, and 5,252,106, the teachings of each of which are incorporated herein by reference, it is desirable to tag organic liquids, particularly petroleum fuels, so that the tagged petroleum fuel may be identified for a variety of reasons, including tax purposes, e.g., road fuel vs. agriculture fuel, product brand identification, and quality, e.g., octane, identification. In many cases, particularly brand identification, the marker should be identifiable quantitatively to ensure against dilution of a tagged fuel with non-tagged fuel.

In a common tagging system, a marker is used which is soluble in fuel and is either not observable to the eye at the concentrations used or is used in conjunction with a dye which masks any color the marker may have. While the marker is soluble in petroleum fuel, it typically has a salt form that is soluble in either acidic or alkaline aqueous solution, whereby the marker may be extracted from the water-immiscible fluid by acidic aqueous solution or alkaline aqueous solution as the case may be. Because the marker is present in the fuel at low concentrations, typically between about 1 and about 100 ppm (parts per million by weight), it is usually a requirement that the marker, as extracted or subsequent thereto, undergo a chromophoric reaction, whereby presence of the marker is readily observable by its strong color.

While a relatively wide variety of such markers have been proposed, in actuality, only a relatively few have actually been accepted for use. There remains a need for additional markers to tag petroleum fuels and the like.

The use of chemicals as markers is to be distinguished from the use of chemicals as dyes. Dyes are used in petroleum fuels to impart color to the fuel. Dyes need only be soluble in petroleum fuel at a concentration so as to impart a desired color. They need not be extractable or color-forming, as is generally the case with markers.

The present invention is directed to a class of chemicals, some of which have been used as petroleum fuel dyes. These dyes, species of which are described in U.S. Pat. No. 5,142,030, the teachings of which are incorporated herein by reference, are not easily extracted. However, it is found herein that alkaline aqueous solutions employing particular co-solvents may be used to quantitatively extract such chemicals from organic fluids, including petroleum fuels.

SUMMARY OF THE INVENTION

In accordance with the invention, a water-immiscible organic fluid is tagged with between about 0.25 and about 100 ppm of a marker compound having the formula:

(I)

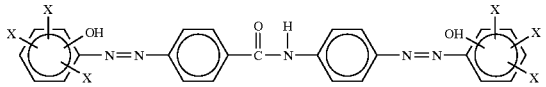

where the OH groups are either ortho or para to the diazo moieties, and the Xs are the same or different and are selected from $C_1$–$C_{12}$-alkyl, Cl, Br, F, $NH_2$, CN, $NO_2$, $NH(C_{1-3}\text{-alkyl})$ and $N(C_{1-3}\text{-alkyl})_2$. To identify the marker compound, the tagged fluid is extracted with an alkaline aqueous extractant having a pH above about 12 and containing, based on 100 parts by weight of the extractant, between about 10 and about 60 parts by weight of an organic cosolvent having the formula:

$$R^1—O—R^2—NH_2 \quad \text{(II)}$$

where $R^1$ is $C_1$–$C_3$-alkyl, and $R^2$ is $C_2$–$C_6$-alkylene. The preferred co-solvent is methoxypropylamine.

As described in above-referenced U.S. Pat. No. 5,142,030, the chemicals used as markers are synthesized by tetrazo coupling of 4,4'-diamino benzanalide (DABA) to phenol or (preferably) a substituted phenol according to the following reaction sequence:

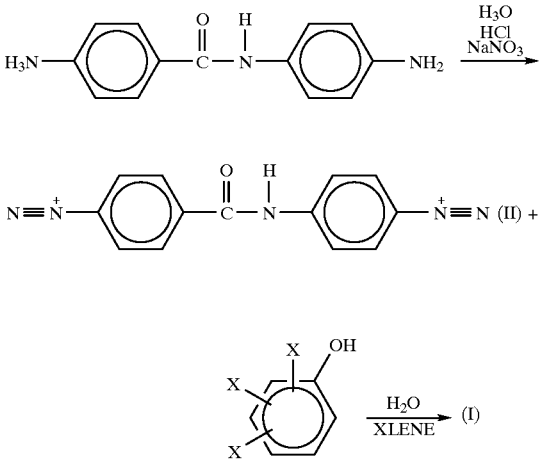

Depending upon the substituent groups on the phenol and their location relative to the —OH group of the phenol, addition will be either preferentially ortho or preferentially para.

As described in above-referenced U.S. Pat. No. 5,142,030, when the —OH group is ortho, these chemicals exhibit color, tending to make them useful as dyes for petroleum fuels. However, these chemicals are still useful as markers in accordance with the present invention when used in conjunction with other dyes which are not co-extracted in the extractant used in accordance with the present invention, often being able to provide a novel color which results from the combination of the two dyes.

On the other hand, when the —OH groups are para to the diazo groups, these chemicals tend to exhibit far less color, such that they are typically non-observable by the naked eye when dissolved in an organic fluid, such as a petroleum fuel, at typical tagging levels, i.e., between about 0.25 and about 100 ppm, preferably at least about 1 ppm, typically between about 5 and about 40 ppm. These compounds, therefore, are particularly useful as silent markers that do not need to be used in conjunction with a masking dye.

The compounds of formula (I) are mostly liquid at room temperature; consequently, they are easy to mix with organic fluids, including petroleum fuels. The chemicals are soluble in a wide variety of organic solvents, giving them wide utility. In addition to petroleum fuels, the chemicals are soluble in xylene, which is used in wood stains, varnishes, and felt tip marker pens; toluene, used for publication gravure inks; Aromatic 200; and Dowanol EPH, used in ballpoint pen inks and ink jet inks.

To detect the marker in a tagged, water-immiscible organic fluid, the fluid is extracted using an extractant as described above. The volume ratio of organic fluid to extractant may vary over a wide range, but is typically between about 20:1 and about 2:1.

The invention will now be described in greater detail by way of example.

EXAMPLE 1

A sample solution of commercially available Automate® (Morton International, Inc.) Yellow D (a compound according to chemical formula (1) above wherein both OH groups are ortho to the diazo groups and wherein each phenol moiety has a nonyl group para to the OH group) was diluted with an equal weight of xylene. A master solution at a concentration of 2400 ppm was then made in xylene. From this master solution was prepared in unleaded regular gasoline a stock solution of marked fuel at 24 ppm concentration.

To 20 ml. of marked fuel in a glass vial was added 10 ml. of reagent DMPK (49 parts water by weight, 2 parts potassium hydroxide, 49 parts methoxypropylamine). After vigorous shaking, a deep red extract developed in the lower aqueous layer upon settling. This extractant layer exhibited an absorbance of 0.754 a.u. at $\lambda$ max of 514 nm.

EXAMPLE 2

The yellow dye solution from Example 1 was blended with a xylene solution of C.I. Solvent Blue 98. A sample of the blend was added to isooctane at 40 ppm concentration to give a kelly green appearance. After typical extraction with reagent DMPK at a fuel to extractant ratio of 2:1, the bottom layer was colored red (absorbance—0.636 a.u.) while the top organic layer was left a blue color.

EXAMPLE 3

The following compares various the efficiency of various extractant solutions to in extractant Automate® Yellow D at 20 ppm concentration from isooctane at a 2:1 fuel to extractant volume ratio:

| Extractant | Color (extract) | Color (organic phase) |
|---|---|---|
| MEPA*/ polyethylene glycol/water | cloudy, pink | yellow |
| methylpyrrolidinone/ water/KOH | weakly red | yellow |
| diethylene glycol/MEPA/water | very slightly purple | — |
| magnesium chloride | weakly orange-red | dark yellow |
| triethanol amine | | |
| 12% HCl | colorless | yellow |
| DMPK | deep red | colorless |

*MEPA = methoxyethoxypropylamine

EXAMPLE 4

The following data shows that extraction of Yellow D from isooctane in DMPK is quantitative.

| Concentration (ppm) | Absorption (514 nm) |
|---|---|
| 24 | 0.704 |
| 18 | 0.513 |
| 12 | 0.349 |
| 6 | 0.189 |
| 3 | 0.092 |
| 1.2 | 0.033 |
| 0 | 0 |

EXAMPLE 5

4,4'-diaminobenzanilide (DABA) was tetrazotized and coupled to two mole equivalents of 2,6-di-sec-butylphenol to produce a compound exhibiting a very faint yellow color to no color when present at concentrations of 20 ppm or less in isooctane. However, when extracted with DMPK, the extractant layer was intensely red, absorbing at 515 nm. This relatively colorless compound is useful as a silent marker.

EXAMPLE 6

DABA was coupled to 2 mole equivalents of a meta-amino phenol and to a dialkylated meta-amino phenol. The first product was weakly soluble in isooctane and gave a pink extract color while the latter gave a deep red color extract at 519 nm due to better solubility and better performance as a liquid marker.

What is claimed is:

1. A method of tagging and identifying a water-immiscible organic fluid comprising:

tagging said organic fluid with between about 0.25 and about 100 ppm of a marker compound having the formula:

(I)

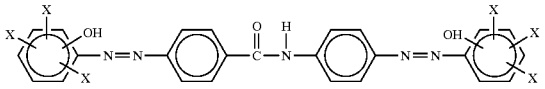

where the OH groups are either ortho or para to the diazo moieties, and the Xs are the same or different and are selected from $C_1$–$C_{12}$-alkyl, Cl, Br, F, $NH_2$, CN, $NO_2$, $NH(C_{1-3}\text{-alkyl})$ and $N(C_{1-3}\text{-alkyl})_2$, and extracting said tagged fluid with an alkaline aqueous extractant having a pH above about 12 and containing, based on 100 parts by weight of said extractant, between about 10 and about 60 parts by weight of an organic cosolvent having the formula:

$$R^1—O—R^2—NH_2 \quad (II)$$

where $R^1$ is $C_1$–$C_3$-alkyl, and $R^2$ is $C_2$–$C_6$-alkylene wherein said extracting produces a color change: and identifying said organic fluid from said color change was inserted.

2. The method according to claim 1 wherein said co-solvent is methoxypropylamine.

3. The method according to claim 1 where in said marker the —OH groups are ortho to the diazo groups and the phenol moieties each have a nonyl group para to said —OH group.

4. The method according to claim 1 where in said marker the —OH groups are para to the diazo groups and the phenol moieties each have two sec-butyl groups ortho to said —OH group.

* * * * *

UNITED STATES PATENT AND TRADEMARK OFFICE

CERTIFICATE OF CORRECTION

PATENT NO. : 5,905,043

DATED : May 18, 1999

INVENTOR(S) : Peter J. Heffron et al.

It is certified that error appears in the above-indentified patent and that said Letters Patent is hereby corrected as shown below:

Column 4, line 53:
Reads "...change: and..." (colon)
Should Read: "...change; and..." (semi-colon)

Column 4, line 55:
Delete : "was inserted."

Signed and Sealed this

Sixteenth Day of November, 1999

*Attest:*

Q. TODD DICKINSON

*Attesting Officer*

*Acting Commissioner of Patents and Trademarks*